US006241570B1

(12) United States Patent
Thorne, III

(10) Patent No.: US 6,241,570 B1
(45) Date of Patent: Jun. 5, 2001

(54) HYDRODYNAMIC THROWING DISC

(75) Inventor: Edwin Thorne, III, Palo Alto, CA (US)

(73) Assignee: Aquatoy, Inc., Palo Alto, CA (US)

( * ) Notice: Subject to any disclaimer, the term of this patent is extended or adjusted under 35 U.S.C. 154(b) by 0 days.

(21) Appl. No.: 09/503,802

(22) Filed: Feb. 14, 2000

Related U.S. Application Data

(60) Provisional application No. 60/150,755, filed on Aug. 26, 1999.

(51) Int. Cl.[7] ..... B63B 35/73

(52) U.S. Cl. ..... 441/136; 446/46; 473/588

(58) Field of Search ..... 441/81, 136; 114/221, 114/315; 446/46, 153; 473/588; 482/21

(56) References Cited

U.S. PATENT DOCUMENTS 2,223,091 * 11/1940 Bresnahan et al. .
2,640,699 * 6/1953 Garbo .
3,544,113 * 12/1970 Hand ..... 473/588
5,014,990 * 5/1991 Kaser .
5,092,608 * 3/1992 Snipes ..... 473/588

* cited by examiner

*Primary Examiner*—Sherman Basinger
(74) *Attorney, Agent, or Firm*—Carr & Ferrell, LLP

(57) ABSTRACT

A gliding or flying hydrodynamic disc designed for recreational use under water. The disc is circular and about 12 inches or 300 mm in diameter, and about ½ inch or 1.198 centimeters high. Circular grooves on the surface of the disc provide a grip surface so that the user can adequately maintain control of the disc under water. The weight of the disc is determined to allow the device to generally maintain equilibrium while under water. The shape and the materials are crafted to provide minimum drag. The top and bottom of the device are symmetrical to minimize drag-inducing lift effects. A soft outer edge surface provides a good grip on the device and for safety in pool and dive use. The disc can also be used as a dive plane or to change course by holding it out in front while the user is swimming.

31 Claims, 5 Drawing Sheets

FIG. 1
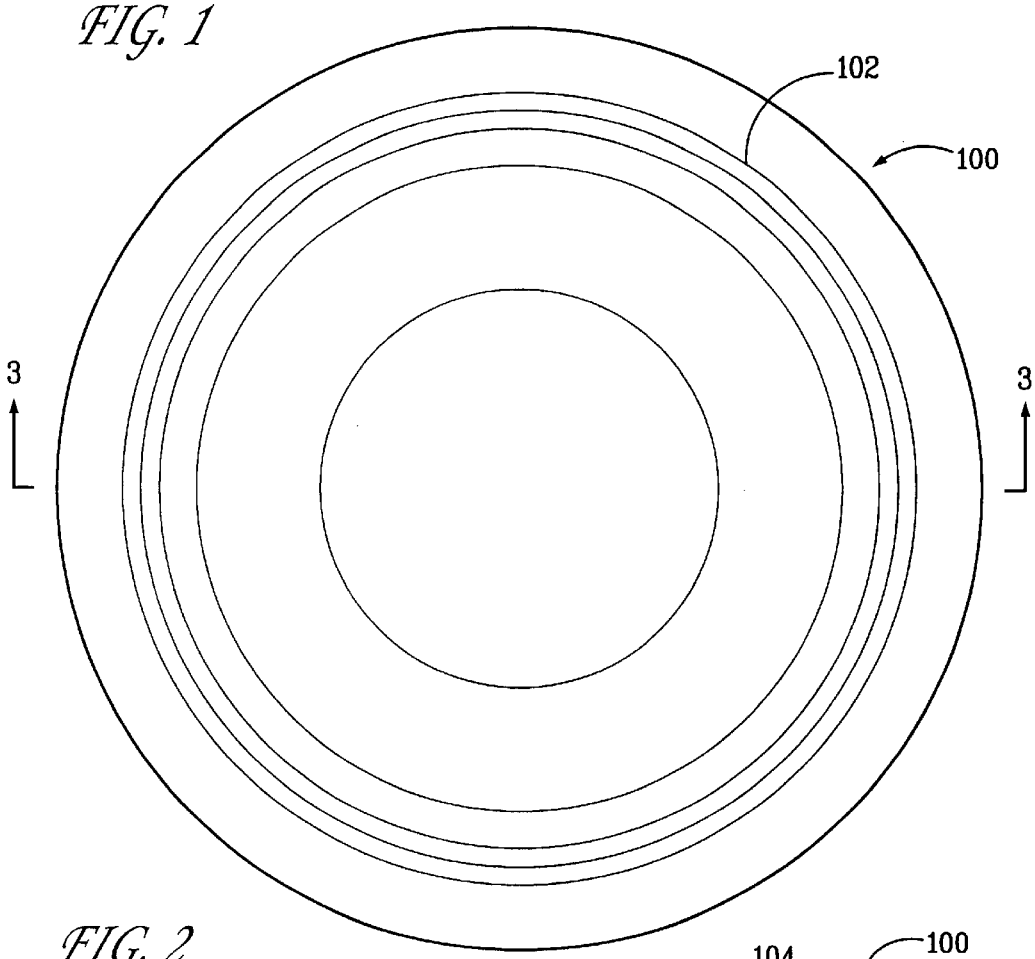
FIG. 2
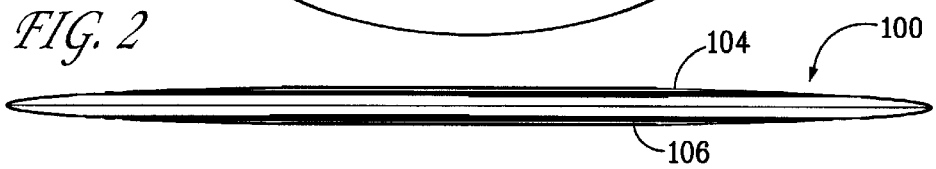
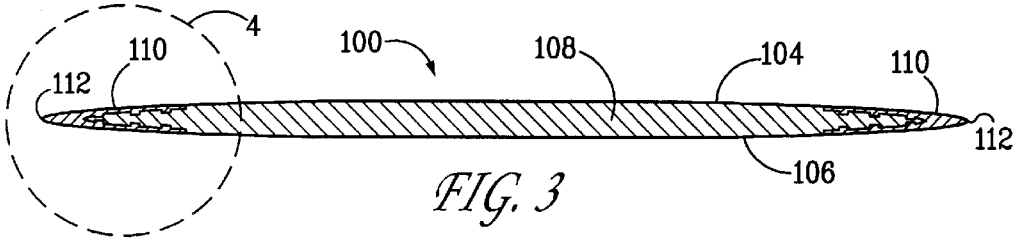
FIG. 3
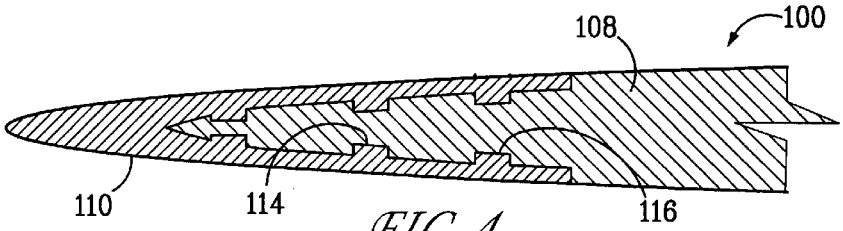
FIG. 4

FIG. 5
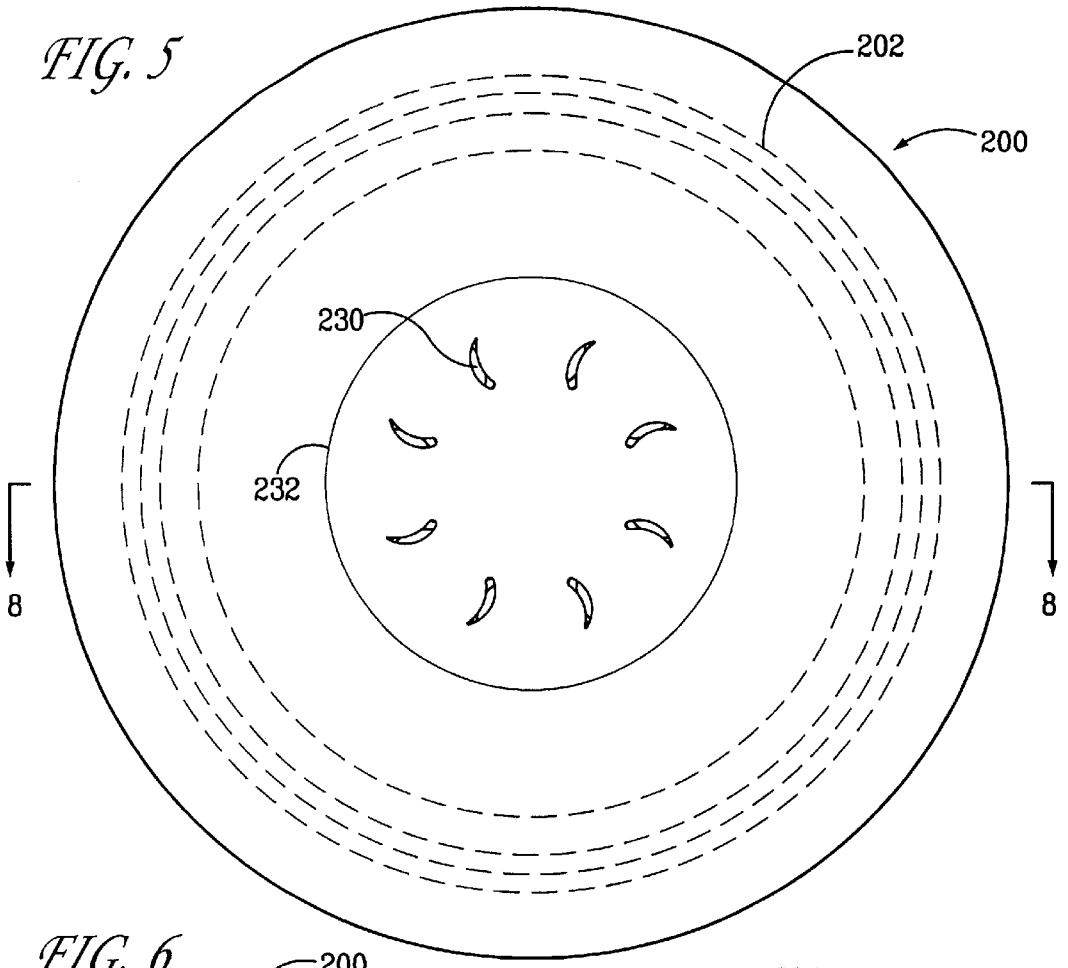
FIG. 6
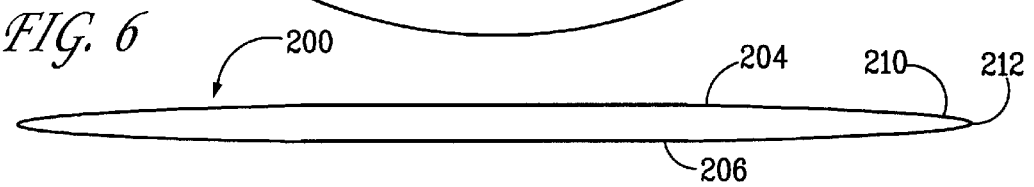
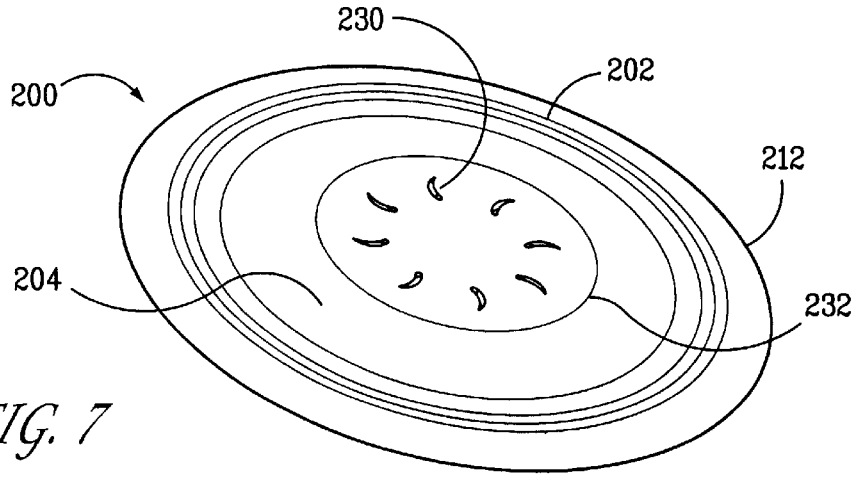
FIG. 7

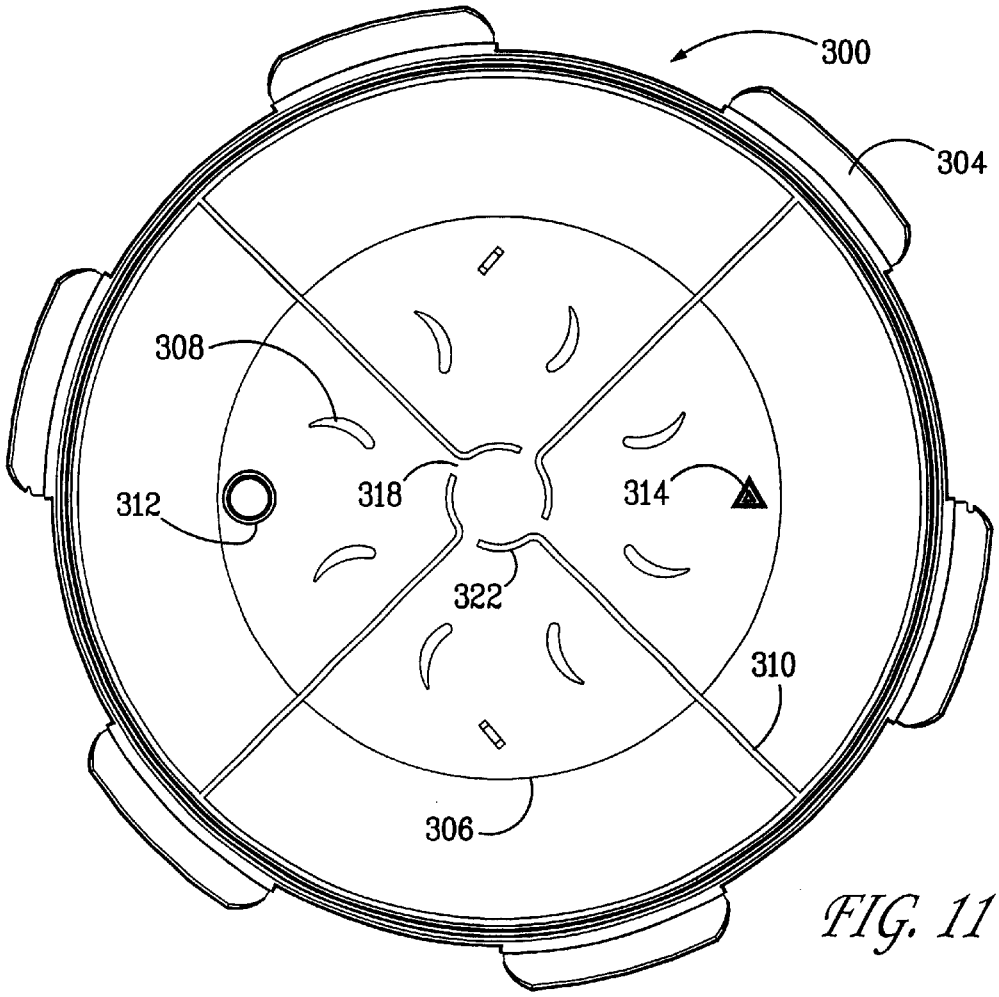
FIG. 11
FIG. 12
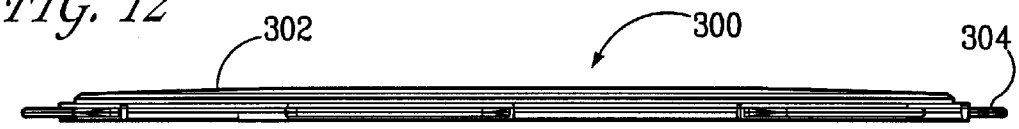
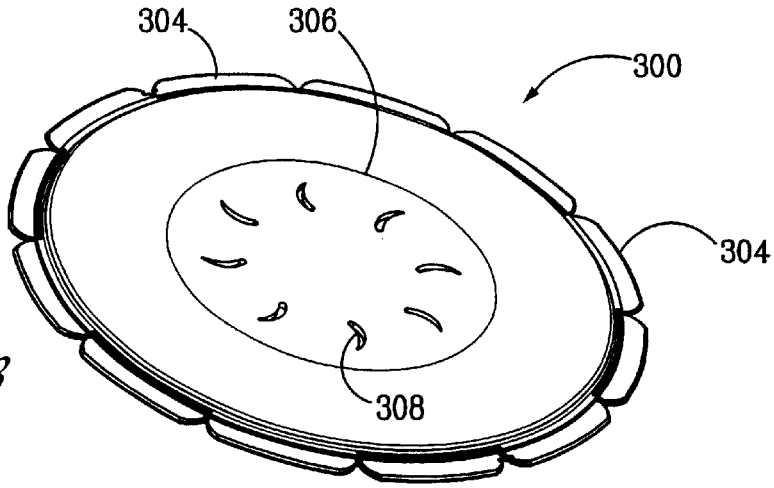
FIG. 13

HYDRODYNAMIC THROWING DISC

CROSS-REFERENCE TO RELATED APPLICATION

This application claims the benefit of U.S. Provisional Application Serial No. 60/150,755, filed on Aug. 26, 1999, entitled "UNDERWATER FLYING DISC," which is incorporated herein by reference.

BACKGROUND OF THE INVENTION

1. Field of the Invention

The present invention relates to throwing discs for recreational use, and more specifically to a hydrodynamic throwing disc for use in a swimming pool, lake, or the ocean.

2. Description of Related Art

There are many toys and recreational devices on the market for use in and around swimming pools and other bodies of water. One such toy is a tire inner tube that is inflated and used as a flotation device. Another is a floating ball, which is waterproof so it will not sink when used in water, such as a pool, lake, or the ocean. Such balls include the type used in water polo, for example. Still other toys or devices include the type that sink to the bottom of a pool and are retrieved by the user diving into the pool. Such toys and recreational objects are used to teach swimming and water safety to young persons, and can even be used to teach SCUBA divers the skill of underwater diving.

A well-known toy or recreational device used out of water is the flying saucer device. These are tossed from one user to another, using the aerodynamic aspects of the device to enable it to glide in the air from the thrower to the catcher. However, such flying saucer devices are difficult, if not impossible, to use under water.

SUMMARY OF THE INVENTION

The present invention relates to a gliding disc toy or device designed for use under water, such as in a pool or the ocean. The invention is a hydrodynamic disc which, in one embodiment, includes a central circular core of a solid construction with a predetermined diameter and height which tapers to an outer edge. The core includes a material to impart a predetermined buoyancy to the disc when used within several feet below the surface of the water. The circular core includes a softer flexible material along the edge and radially inward a short distance along the top and bottom surfaces to provide a gripping surface and safety protection to disc users. The disc may have either a neutral, a positive, or a negative buoyancy.

An alternate embodiment includes a central circular core of a hollow construction with a predetermined diameter and height having first and second surfaces which taper to the outer edge. The hollow core is partially or completely filled with water to control the buoyancy. Still another embodiment of the disc includes identical first and second sides each having a circular member with an inner section of a first diameter and an outer section extending from the first diameter to a second diameter. The inner section has a height much less than the second diameter of the outer section. The outer section includes radial tabs emanating radially outward. The inside surfaces of the first and second sides are positioned against each other to form a symmetrical body. Each side of the disc includes a material of a first stiffness and a second material formed over the radial tabs so that the second material extends beyond the peripheral edges of the first and second sides in a taper to a rounded peripheral edge of the disc.

DESCRIPTION OF THE DRAWINGS

The present invention may be better understood, and its numerous features and advantages made apparent to those skilled in the art by referencing the accompanying drawings. For ease of understanding and simplicity, common numbering of elements within the illustrations is employed where an element is the same in different drawings.

FIG. 1 is a top plan view of a hydrodynamic throwing disc incorporating the principles of the invention;

FIG. 2 is an edge view of the disc of this invention;

FIG. 3 is a sectional view of the disc taken in the direction of lines 3—3 of FIG. 1;

FIG. 4 is a sectional view of the edge of the disc, taken about portion 4 in FIG. 3;

FIG. 5 is a top plan view of a second embodiment of a hydrodynamic throwing disc according to the invention;

FIG. 6 is an edge view of the disc of FIG. 5;

FIG. 7 is a perspective view of the disc of FIG. 5;

FIG. 11 is a bottom plan view of the disc half shown in FIG. 10;

FIG. 12 is an edge section view of the disc half shown in FIG. 10;

FIG. 13 is a perspective view of the fully assembled disc after two of the halves of FIG. 10 are joined together;

DETAILED DESCRIPTION OF THE INVENTION

Figure 8:
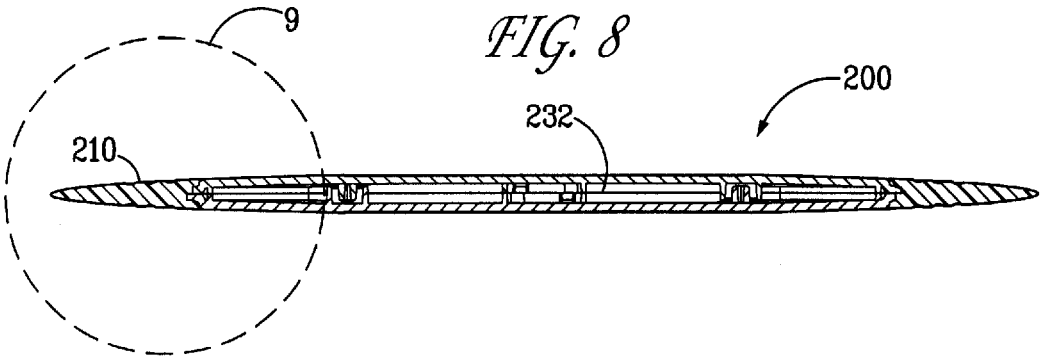
FIG. 8 is a sectional view taken in the direction of lines 8—8 of FIG. 5.

The following is a detailed description of illustrative embodiments of the present invention. As these embodiments of the present invention are described with reference to the aforementioned drawings, various modifications or adaptations of the methods and or specific structures described may become apparent to those skilled in the art. All such modifications, adaptations, or variations that rely upon the teachings of the present invention, and through which these teachings have advanced the art, are considered to be within the spirit and scope of the present invention. For example, the devices set forth herein have been characterized herein as recreational toys, but it is apparent that professional and training uses may also be found for these devices. Hence, these descriptions and drawings are not to be considered in a limiting sense as it is understood that the present invention is in no way limited to the embodiments illustrated.

The present invention provides a gliding disc toy or device for use under water with a throwing or pushing motion. Most toys or devices used for recreational use under water are too light and they float, or are too heavy and they sink. Such toys or devices quickly lose the interest of users, as they have to be retrieved after every action. However, this invention was designed specifically to be used under water as if it were used out of water. The disc of the present invention has a generally symmetrical or neutral buoyancy to maintain it mostly level in the water. This requires additional design to ensure that the device does not sink or rise to the top appreciably before it has completed its desired action.

This invention provides a new way to play catch and other games under water. The shape and the materials are crafted to provide minimum drag; specifically, the top and bottom of the device are symmetrical to minimize drag-inducing lift effects. The solid core provides a rigidity necessary to allow the disc to cut through the water. The soft outer edge provides a good grip on the device for effective and safe use in the water. The disc can also be used as a dive plane by the user holding it in front while swimming or to change direction while swimming under water.

FIG. 1 is a top view of the underwater flying disc 100. The overall shape of disc 100 is circular and its size is about 12 inches or 300 mm in diameter. Circular grooves 102 on the surface of disc 100 provide a grip surface so that a user can maintain adequate control of the disc under water. Raised ridges could be used, but are generally not, as ridges cause more turbulence and drag. The weight of disc 100 is determined to allow the device to be near equilibrium while under water. That is, unless thrown or otherwise moved in the water, disc 100 will not rapidly sink to the bottom or float to the surface. This is advantageous in that as a user swims to the surface for more air, for example, disc 100 remains in the water generally near where the user left it. A heavier disc would travel further through the water and a denser disc would sink slowly when not in active use. Different variations of buoyancy of the device, however, could provide for a slightly heavier (negative buoyancy) unit for divers, and slightly lighter (positive buoyancy) unit for use by children, for example.

FIG. 2 is an edge view of disc 100, showing it to be very flat with a large width to height ratio. The "top" surface 104 and "bottom" surface 106 of disc 100 are symmetrical and the disc is used indifferently with either surface 104 or 106 up or down; thus there is no real top or bottom. This allows the disc to move in the water without undesirable drag-inducing lift effects. The previously-mentioned flying saucer toys used in the air, and not in water, are generally flat and have a downward facing concave shape, which provides lift to more or less float the flying saucer toy upon the air. Such a shape would be detrimental and would seriously curtail movement of the flying saucer if such an article were attempted to be used under water. The symmetrical design and heavier weight of disc 100 of this invention allows for easy movement in the water upon being pushed, thrown or launched by a user.

FIG. 3 shows a cross section of disc 100. The disc is made of a first central core material 108 of, for example, rigid polypropylene or its equivalent. The volume of the particular embodiment shown in FIG. 3 is approximately 454 cubic centimeters. The overall diameter of disc 100 is about 12 inches (30 centimeters) and the center height is about ½ inch (1.2 centimeters). Surfaces 104 and 106 have a polished texture. Edge 110 of disc 100 is made of a softer material to provide a better gripping surface, and also for protection of the users, whose vision may not be as good under water as out of water, in the event the disc is not seen and caught but rather strikes a user. This edge material is soft flexible polypropylene or its equivalent, and the volume of the material as used in this embodiment is about 127.15 cubic centimeters. A typical disc 100 twelve inches in diameter and ½ inch in height made of the aforementioned materials weighs about 630 grams. As with all the embodiments disclosed herein, other suitable materials may be used.

FIG. 4 is an enlarged view of the portion B of disc 100 described in conjunction with FIG. 3. The softer material 110 has protruding annular ridges 114 that mate and provide a snug fit with recessed annular grooves 116 in central core 108. Through-holes (not shown) in the edge of the central core, if provided, could, if desired, provide mechanical strength to the softer material.

In operation, a user would grip disc 100 with the thumb of his/her hand on one side (probably the upper surface) with the fingers on the other side (probably the lower surface). With disc 100 in the user's hand, the user would move the arm holding the disc in a backhand motion across his/her body and away from the body towards another user in the pool some six to ten feet or so away. As the user's hand passes in front of the user's body, the user relaxes his/her grip on disc 100 and the weight of the disc and its forward motion causes the disc to glide towards the other user. The hydrodynamic shape of disc 100 and its predetermined weight allows the disc to move smoothly in the water to the other user, who grabs the disc in his/her hand. This person will then launch disc 100 back to the other person in the same manner. Of course, users may find their own methods of launching the disc in the water, such as overhand or forehand, or pushed. Disc 100 is designed for underwater use, but may also be used to skim the surface of the water.

While the above embodiment has a solid disc core, a second embodiment includes a hollow core that is filled with water or air to adjust the buoyancy of the disc. This allows a lighter disc to be transported and allows for adjustments if the disc is used at different depths or in salt water. A simple valve system could be employed to achieve the desired buoyancy.

The second embodiment of this invention is shown in FIG. 5 through FIG. 9. FIG. 5 shows underwater flying or gliding disc 200 to be similar to that described above in conjunction with FIG. 1. FIG. 5 shows that the overall dimension of disc 200 is also about 300 mm in diameter. Similar to the embodiment of FIG. 1, there are circular depressions or grooves 202 on the surface 204 of disc 200, which allow the user to adequately grip and launch the disc under water. These circular depressions and grooves might be manufactured on one side only and thus the surface seen in FIG. 5 would probably be used as the top side when it is tossed. However, it is possible that the embodiment shown in FIG. 5 would have the circular ridges and depressions manufactured on the other side as well to allow for a symmetrical gliding disc. Such a symmetrical flying disc would then, of course, not have an inherent top or bottom.

FIG. 5 also shows the crescent-shaped vent holes 230 which, in this embodiment, are open to a central section or cavity 232 of the underwater flying disc. While the embodiment shown in FIG. 1 has a solid central core and a softer outer section, as seen in FIG. 4, the embodiment shown in FIG. 5 has the hollow central cavity 232 open via vent holes 230 to the outside. If, as set forth previously, the underwater flying disc is to be completely symmetrical, the opposite side of the disc could also have these vent holes on the matching surface. However, it should be understood that it is not necessary to have these holes on both sides, depending on the size of the holes and the use for which the holes are intended.

The holes 230 are provided in hollow central core 232 so that when the disc is first used, it would be submerged in the water to allow water to flow into the central core and force out any air that may be there. This provides for easier and cheaper manufacture, because it utilizes less material. It also allows for a lighter article which is useful for a user who has to carry the underwater disc; and, of course, for the manufacturer and seller who have a lighter article to ship and to handle in a store. When disc 200 is used under water, hollow central cavity 232 would quickly fill with water. The water provides additional weight to allow disc 200 to be adequately moved through the water by a user.

FIG. 6 is a side view of underwater flying disc 200 seen in FIG. 5. The thickness of disc 200 is about 11.5 mm which equals the ratio of the diameter to thickness as that embodiment discussed above. FIG. 6 shows disc 200 top surface 204, bottom surface 206, and edge 210 which tapers gradually to a smooth rounded shape 212. Edge 212 and the grooves and depressions 202 allow for movement in the water while providing a gripping surface for the user. FIG. 7 is a perspective view of the embodiment shown in FIG. 5.

Figure 9:
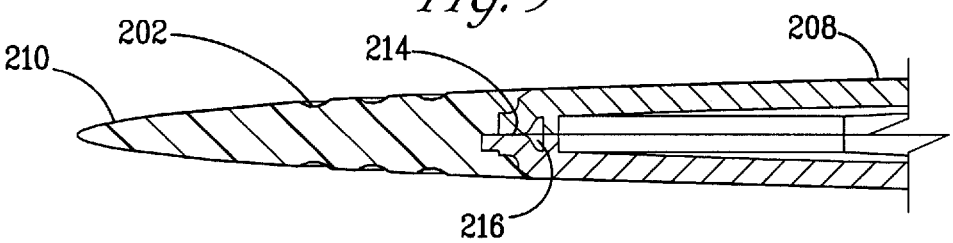
FIG. 9 is a sectional view of the edge of the disc taken about portion 9 in FIG. 8.

FIG. 8 is a side section view of the embodiment shown in FIG. 5, and shows central core 232 with the hollow center section to be filled with water. Edge 210 of disc 200, which is indicated by circle B in FIG. 8, is detailed in FIG. 9. Center section 208 is made of polypropylene, with a volume of about 454 cubic centimeters with a fine texture (if desired), or equivalent material. FIG. 9 shows edge material 210 of disc 200, which is softer to prevent injuries and is made of soft polypropylene, or equivalent material, with a volume of about 127.15 cubic centimeters. A typical disc made of the aforementioned materials would weigh about 488 grams, or about 1 pound, 1.2 ounces, when empty. Similar to the embodiment shown in FIG. 4, central core 208 has its own ridges 214 and/or depressions 216 so that when the over-molded material is molded onto the central core 208, there is an adequate gripping surface 202 and the structure makes a more solid and rigid unit.

The embodiments shown in FIGS. 1 through 4 provide for any solid central core with an overmolded edge as manufactured. The embodiment shown in FIG. 5 through FIG. 9 allows for hollow center section 232 with holes 230 to provide a generally neutral buoyancy in the water. The water in the central cavity provides the necessary added weight to the flying disc.

Figure 10:
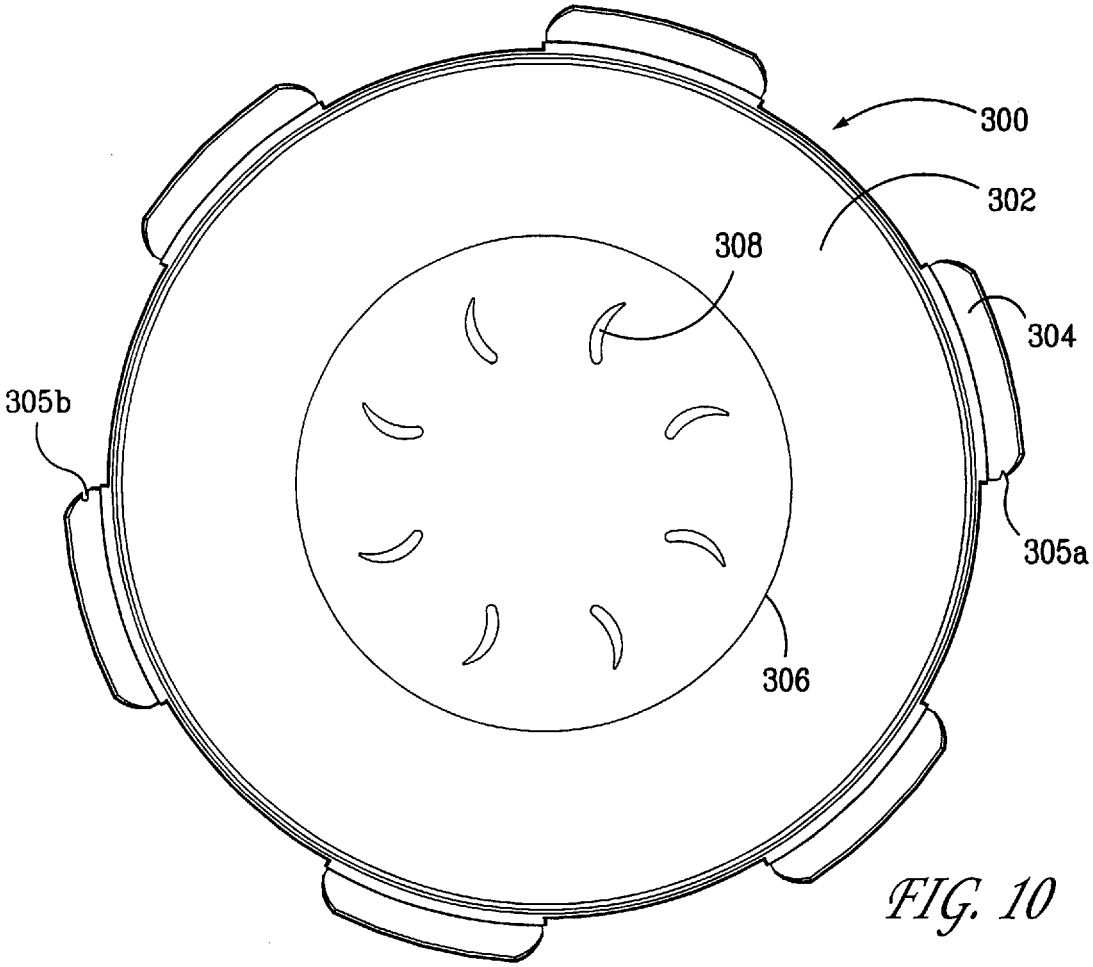
FIG. 10 is a top plan view of one-half of a third embodiment of a hydrodynamic throwing disc according to this invention.

However, still another embodiment may be utilized such that the center section may be made out of two identical pieces which are joined together and then over-molded around the outer periphery of the disc to allow for a softer edge. FIG. 10 shows a different embodiment of this invention which comprises two identical halves 302 which are snapped together with the outer edge tabs 304 being overmolded with the softer material. FIG. 10 shows one surface of the underwater flying disc 300 with center hollow section 306 including vent holes 308 that allow cavity 306 to fill with water upon immersion. Around the edge of the center core are tabs 304, six of which are seen in FIG. 10, each tab 304 occupying about one-twelfth (1/12) of the circumference of the outer edge. It is noted that indents 305*a* and 305*b* are indications to an assembler in manufacturing how to quickly line up the halves of the disk for plastic injection.

FIG. 11 shows the inside of the same half of disc 300 seen in FIG. 10 with the six outer tabs 304. The cross members 310 in the inner surface of disc 300 are support ridges molded therein to help prevent disc 300 from flexing, and to add strength and stability to the half shown in FIG. 11. The cross members 310 end in the center of the disc at a curved portion 322 for each cross member. The curved portions define a circle with four openings 318 which allow for rapid ingress of water upon initial submersion into the water, and rapid egress of the water when taken out of the water. The cross members also provide for a water stop to keep the water from excessive movement inside the disc chamber when the disc is thrown or tossed. Such water movement can slow the rotation of the disc and cause drag.

Also seen in FIG. 11 is a boss 312 and pin 314 arrangement. Pin 314 provides the male portion that would be snapped into place on a complementary boss 312, or female portion, on the other half of the disc to which it is mated. Pin 314 is shown triangular in shape for easy manufacture and assembly; but could be any shape to accomplish this end result.

FIG. 12 is a side view of the half shown in FIGS. 10 and 11 before two of them are snapped together.

To make a completed flying disc requires two of the same halves of flying disc 300 shown in FIGS. 10 to 12. Once the halves of disc 300 are manufactured, the inside surface of the half as depicted in FIG. 11 is placed against the inside surface of the other half, but rotated 180 degrees so that the protruding pin 314 on one inside surface would snap into the boss 312 on the other half, such that there are two bosses and two pin engagements which hold the disc together.

Figure 14:
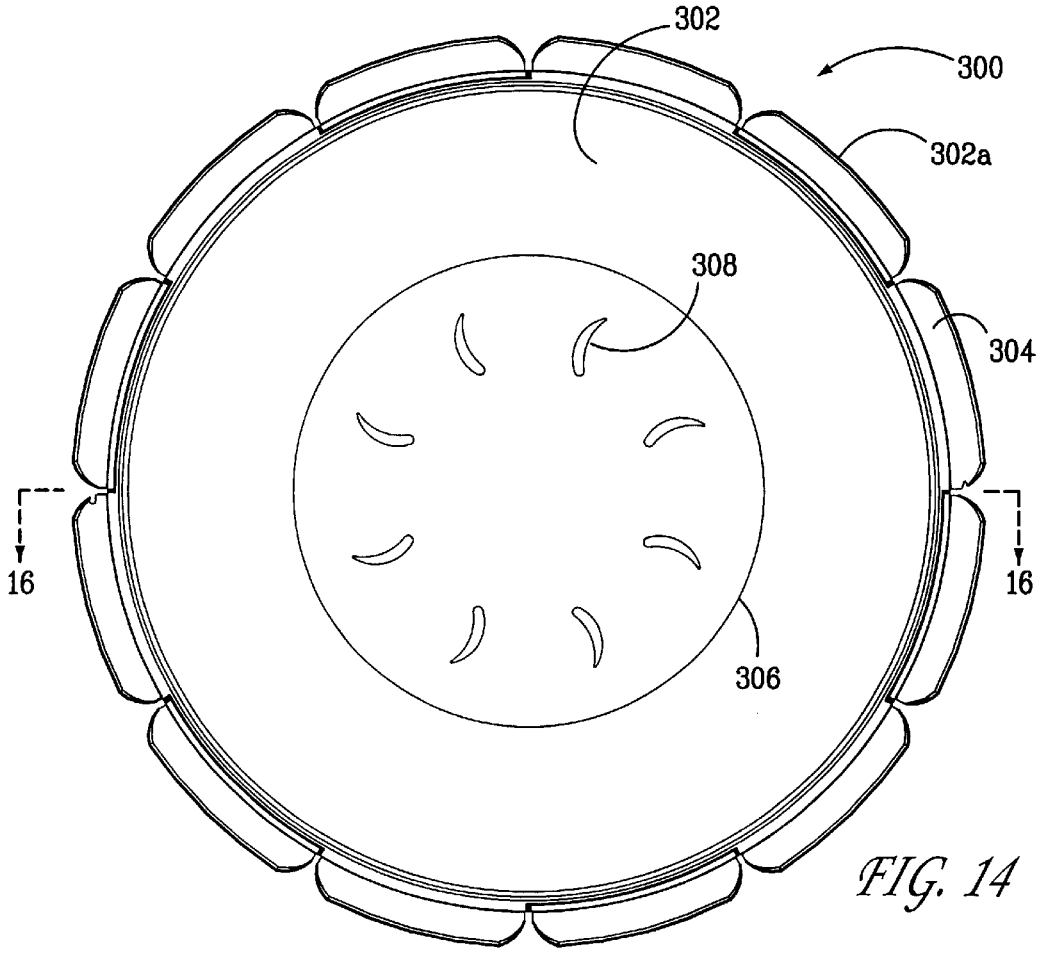
FIG. 14 is a top plan view of the disc of FIG. 13.

After the mating of one section or half of disc 300 with the other half of the disc is completed, the disc now looks like disc 300 seen in perspective in FIG. 13. That is, tabs 304 of one half disc 302 occupy the spaces between tabs 304 of the other half disc 302*a* after being combined during the manufacturing cycle. FIG. 14 is a top view of disc 300 after having both halves 302, 302*a* snapped together as previously described. The overall diameter of disc 300 is about 300 mm after assembly and the over-molding over the assembled tabs is applied. After plastic mold injection of each half, the halves are snapped together as set forth above and then placed in another injection molding machine wherein the edge material is molded over the tabs such that the end result is a flying disc similar to those seen in FIG. 1, FIG. 5, and FIG. 7.

Figure 15:
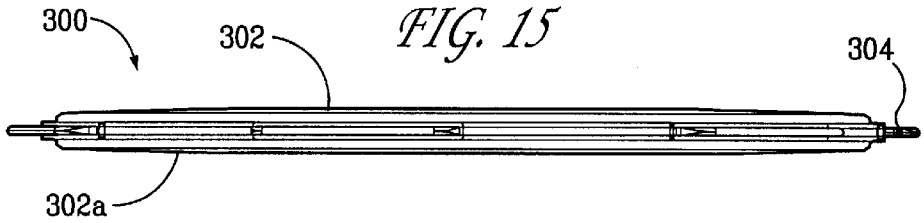
FIG. 15 is an edge view of the disc of FIG. 13.
Figure 16:
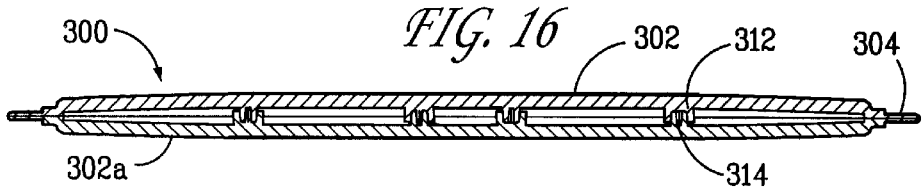
FIG. 16 is a sectional view taken in the direction of lines 16—16 of FIG. 14.

FIG. 15 is an edge view of disc 300 of this invention and is about 11.5 mm in height after the two sections 302, 302*a* are mated to each other. FIG. 16 is a side section view of flying disc 300 after the two halves 302, 302*a* have been snapped together, but prior to the over-molding of the edge sections with flexible material. FIG. 16 shows how the tabs 304 overlap to provide for a strong gripping effect of the over-molding material once applied. Also shown in the relationship of pin 314 and boss 312 after mating of both identical halves.

The material for manufacturing the embodiments in FIG. 13 through FIG. 16 comprise the polypropylene material which occupies about 454 cubic centimeters of space with a fine or no external texture. The overmold material includes the edge material extending a certain distance radially from the edge includes polypropylene or softer material with a volume of about 127.15 cubic centimeters with a fine or no texture. Other suitable material may be used.

While the invention has been described with reference to specific embodiments, it will be understood by those skilled in the art that various changes may be made and equivalents may be substituted for elements thereof without departing from the true spirit and scope of the invention. In addition, modifications may be made without departing from the essential teachings of the invention.

What is claimed is:

1. A hydrodynamic throwing disc for use within a body of water, comprising:

a circular, substantially convex first side and a circular, substantially convex second side;

a center;

a solid central core section between said first side and said second side, having a density that makes the density of said disc substantially equal to the density of water; and an annular outer edge formed by the intersection of said first side and said second side.

2. The disc of claim 1, wherein said first side has a gripping surface.

3. The disc of claim 2, wherein said gripping surface comprises a plurality of concentric annular grooves located at predetermined radii from said center.

4. The disc of claim 2, wherein said gripping surface comprises a plurality of concentric annular ridges located at predetermined radii from said center of said disc.

5. The disc of claim 1, wherein said first side and said second side each have a gripping surface.

6. The disc of claim 5, wherein said gripping surface comprises a plurality of concentric annular grooves located at predetermined radii from said center of said disc.

7. The disc of claim 5, wherein said gripping surface comprises a plurality of concentric annular ridges located at predetermined radii from said center of said disc.

8. The disc of claim 1, wherein said annular outer edge is made of a deformable, resilient material.

9. A hydrodynamic throwing disc for use within a body of water, comprising:

a circular, substantially convex first side and a circular, substantially convex second side;

a hollow central core section between said first side and said second side, which houses a chamber that can be controllably filled with a substance such that said disc has a substantially neutral buoyancy relative to said body of water; and an annular outer edge formed by the intersection of said first side and said second side.

10. The disc of claim 9 wherein said hollow central core section defines vent holes for filling and emptying said substance into and from said chamber.

11. The disc of claim 9 wherein said hollow central core section comprises a valve to control the filling and emptying of said substance from said chamber.

12. The disc of claim 9 wherein said first side has a gripping surface.

13. The disc of claim 12, wherein said gripping surface comprises a plurality of concentric annular grooves located at predetermined radii from the center of said disc.

14. The disc of claim 12, wherein said gripping surface comprises a plurality of concentric annular ridges located at predetermined radii from the center of said disc.

15. The disc of claim 9 wherein said first side and said second side each have a gripping surface.

16. The disc of claim 15, wherein said gripping surfaces each comprise a plurality of concentric annular grooves located at predetermined radii from the center of said disc.

17. The disc of claim 15, wherein said gripping surfaces each comprise a plurality of concentric annular ridges located at predetermined radii from the center of said disc.

18. The disc of claim 9, wherein said annular outer edge is made of a deformable, resilient material.

19. The disc of claim 9, further comprising support ridges disposed inside said chamber to provide rigidity to said disc.

20. A hydrodynamic throwing disc for use within a body of water, comprising:

a first plate having
- a center,
- an outer circumference,
- a plurality of tabs emanating radially from said outer circumference,
- an inside surface with an extending boss disposed at a predetermined distance from said center of said plate, and
- an extending pin disposed at said distance from said center and 180 degrees from said boss;

a second plate identical to said first plate, wherein said boss of each plate mates with said pin of the other plate and said tabs of said first plate alternate with said tabs of said second plate, forming a first side and a second side of said disc;

a hollow central core section, formed by the union of said first plate with said second plate, which houses a chamber that can be controllably filled with a substance such that said disc has a substantially neutral buoyancy relative to said body of water; and an annular outer edge.

21. The disc of claim 20 wherein said hollow central core section defines vent holes for filling and emptying said substance into and from said chamber.

22. The disc of claim 20 wherein said hollow central core section comprises a valve to control the filling and emptying of said substance from said chamber.

23. The disc of claim 20 wherein said first side has a gripping surface.

24. The disc of claim 23, wherein said gripping surface comprises a plurality of concentric annular grooves located at predetermined radii from a center of said first side of said disc.

25. The disc of claim 23, wherein said gripping surface comprises a plurality of concentric annular ridges located at predetermined radii from the center of said disc.

26. The disc of claim 20 wherein said first side and said second side each have a gripping surface.

27. The disc of claim 26, wherein said gripping surface comprises a plurality of concentric annular grooves located at predetermined radii from the center of said disc.

28. The disc of claims 26, wherein said gripping surface comprises a plurality of concentric annular ridges located at predetermined radii from the center of said disc.

29. The hydrodynamic throwing disc of claim 20, wherein said annular outer edge is made of a deformable, resilient material.

30. The disc of claim 20, further comprising support ridges disposed inside said chamber to provide rigidity to said disc.

31. A method of manufacturing a hydrodynamic throwing disc, comprising the steps of:

providing a first plate having
- a center,
- an outer circumference,
- a plurality of tabs emanating radially from said outer circumference,
- an inside surface with
  - an extending boss disposed at a predetermined distance from said center of said plate, and
  - an extending pin disposed at said distance from said center and 180 degrees from said boss;

providing a second plate identical to said first plate;

positioning said first plate in reference to said second plate such that
- said inside surface of said first plate faces said inside surface of said second plate,
- said boss of said first plate aligns with said pin of said second plate and said boss of said second plate aligns with said pin of said first plate, and
- said tabs of said first plate alternate with said tabs of said second plate; and mating said boss of each plate with said pin of the other plate.

* * * * *